United States Patent [19]

Ganser

[11] Patent Number: 4,826,080

[45] Date of Patent: May 2, 1989

[54] FUEL INJECTION DEVICE FOR INTERNAL COMBUSTION ENGINES

[76] Inventor: Marco A. Ganser, Schanzengasse 29, 8001 Zürich, Switzerland

[21] Appl. No.: 936,396

[22] Filed: Dec. 1, 1986

[30] Foreign Application Priority Data

Dec. 2, 1985 [CH] Switzerland ..... 121/85
Dec. 3, 1985 [CH] Switzerland ..... 133/85

[51] Int. Cl.[4] ..... F02M 47/02
[52] U.S. Cl. ..... 239/88; 239/585
[58] Field of Search ..... 251/30.05, 30.02, 44, 251/337, 129.15; 234/585, 96, 94, 533.3–533.12; 123/447, 458, 459

[56] References Cited

U.S. PATENT DOCUMENTS

| | | | |
|---|---|---|---|
| 1,890,702 | 12/1932 | Steiner | 239/96 X |
| 2,347,363 | 4/1944 | Palumbo | 239/96 X |
| 3,227,742 | 1/1986 | Berchtold | 123/458 |
| 3,464,627 | 9/1969 | Huber | 123/447 |
| 3,610,529 | 10/1971 | Huber | 239/96 |
| 4,129,256 | 12/1978 | Bader, Jr. et al. | 239/96 |
| 4,414,940 | 11/1983 | Loyd | 123/299 |
| 4,545,352 | 10/1985 | Jourde et al. | 123/447 |
| 4,606,502 | 8/1986 | Naschberger | 239/585 |
| 4,690,373 | 9/1987 | Linder et al. | 239/585 X |

FOREIGN PATENT DOCUMENTS

| | | | |
|---|---|---|---|
| 0174083 | 3/1986 | European Pat. Off. . | |
| 0196265 | 3/1986 | European Pat. Off. . | |
| 675199 | 8/1979 | U.S.S.R. | 239/585 |
| 1198240 | 12/1985 | U.S.S.R. | 239/585 |
| 1097752 | 1/1968 | United Kingdom . | |

*Primary Examiner*—Andres Kashnikow
*Assistant Examiner*—Kevin P. Weldon
*Attorney, Agent, or Firm*—Lowe Price LeBlanc Becker & Shur

[57] ABSTRACT

The opening and closing movement of a injector valve member (32) which closes and temporarily opens discharge orifices (52) communicating with the combustion chamber of an internal combustion engine, for example a diesel engine, is controlled by the fuel pressure in a control chamber (42) arranged at one end of the injector valve member (32). The fuel pressure in said control chamber (42) is controlled by two orifices (26,38) communicating with one another. One of the orifices (38) is connected to a high pressure fuel inlet (12). The other orifice (26) is closed at one end by a solenoid operated pilot valve (72). Opening of the latter results in a single fuel jet passing through the orifices (26,38) which causes the opening of the injector valve member (32).

35 Claims, 6 Drawing Sheets

FUEL INJECTION DEVICE FOR INTERNAL COMBUSTION ENGINES

TECHNICAL FIELD

The present invention relates generally to a fuel injection device and more particularly to accumulator injection devices for internal combustion engines.

BACKGROUND AND SUMMARY OF THE INVENTION

Different designs of accumulator injection devices are disclosed in the following publications: Swiss Patent Specification 434,875; U.S. Pat. Nos. 3,464,627; 3,610,529; 3,680,782 and 4,545,352; German Published Application (Offenlegungsschrift) 3227 742 and corresponding U.S. Pat. No. 4,566,416; Published International (PCT) Application WO 78/00007 as well as in U.S. patent application Ser. No. 715,354; filed Mar. 25, 1985 and assigned to Stanadyne, Inc.

In the accumulator injectors disclosed in the above mentioned publications a certain amount of fuel is stored under high pressure in a chamber called accumulator, which is located in the injector body upstream of the seat of the injector needle valve. Downstream of this seat are located the injection orifices which communicate with the combustion chamber of the related internal combustion engine. At the beginning of the injection event the injector needle valve opens fast. Because of the fuel compressed in the accumulator a fast rise of the injected fuel rate from the injector into the combustion chamber occurs. This peculiarity of accumulator injectors is detrimental upon engine combustion; high combustion noise level and increased nitric oxide emissions being the result of this fact.

In order to get those conditions under control it is necessary to slowly increase the rate of the injected fuel flow at the beginning of the injection event, which can be achieved if the injector needle valve opening motion can be controlled. Furthermore the slower injector needle valve opening motion shall not influence its closing motion, which should be as fast as possible, again for improved combustion. This taylored opening and closing behaviour of the injector needle valve, together with the choice of the type of injector tip and injection holes brings about a desired shape of the injection rate; the process of controlling this property is called "rate shaping".

An injector design is simple if the number of tight fits and lapped surfaces are minimized. The same is valid for the number of injector components and for their geometry, which should be easily machinable. In addition it is important that the injector may be assembled and calibrated to its correct mode of operation on an automated calibration machine.

The main purpose of the present invention is to disclose new and improved design solutions which allow to control the opening and closing motions of the injector needle valve. In addition, the present invention aims to provide injecting devices which are more simple in construction and thus less expensive to be manufactured compared with the prior art solutions.

Advantageous embodiments of the invention are discussed in the description below and shown in the drawings.

Figure 1:
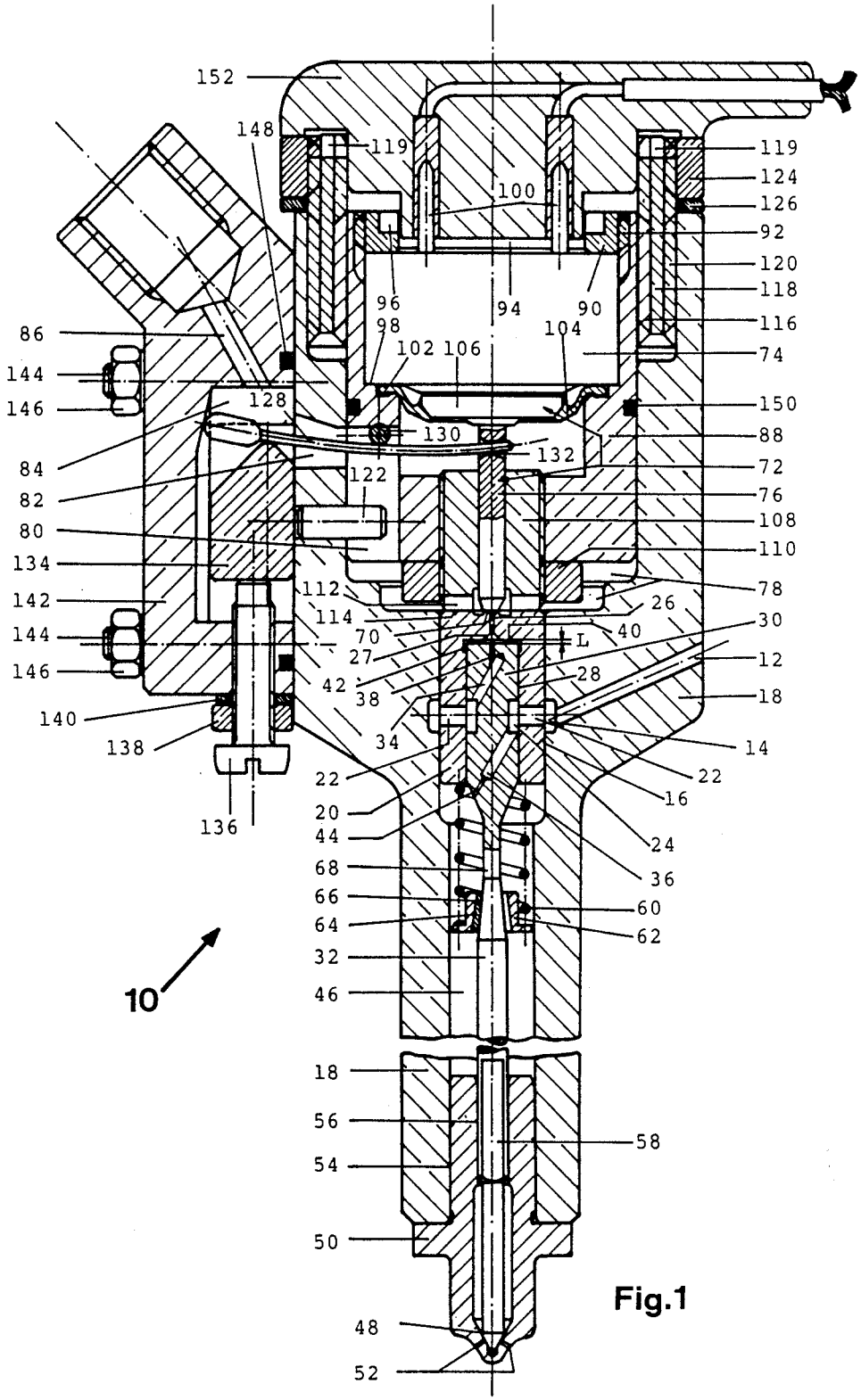
FIG. 1 is an axial sectional view of an accumulator injector in accordance with the present invention.
Figure 3:
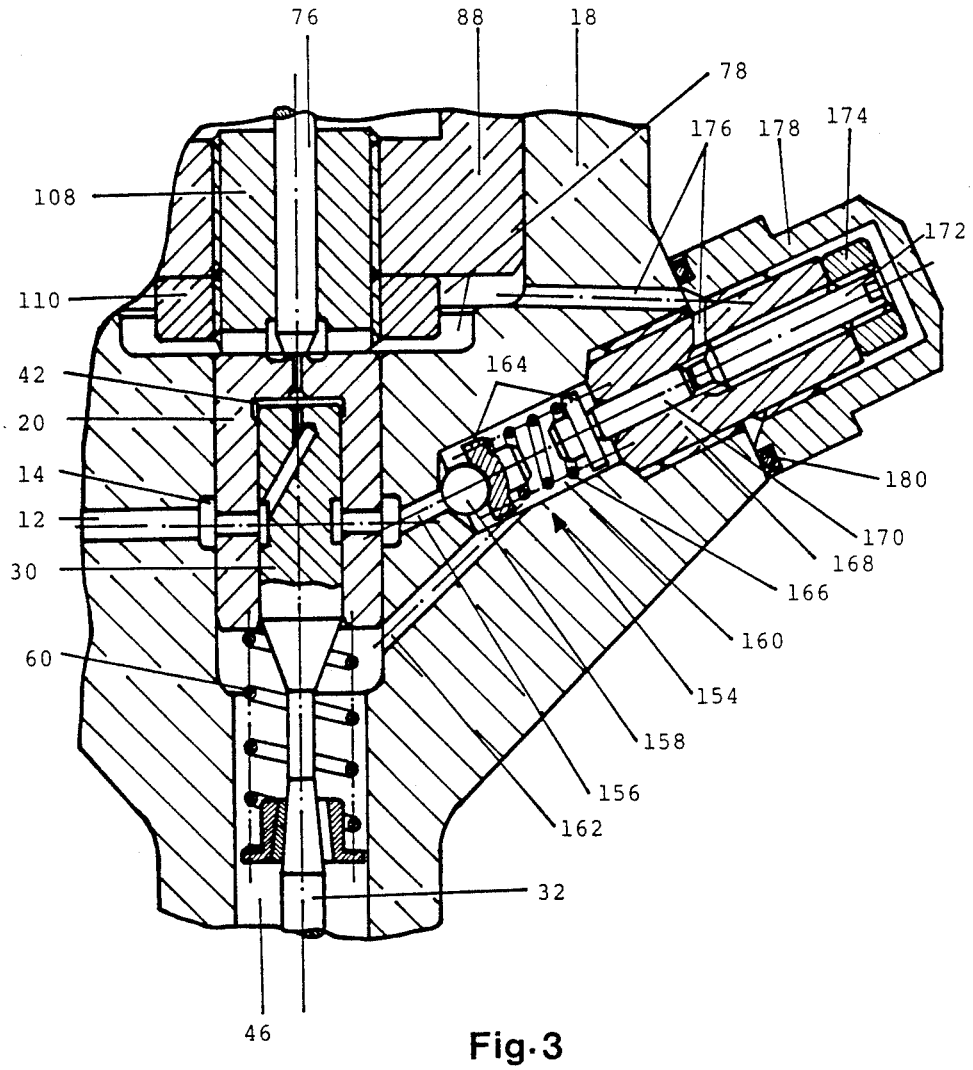
Figure 4:
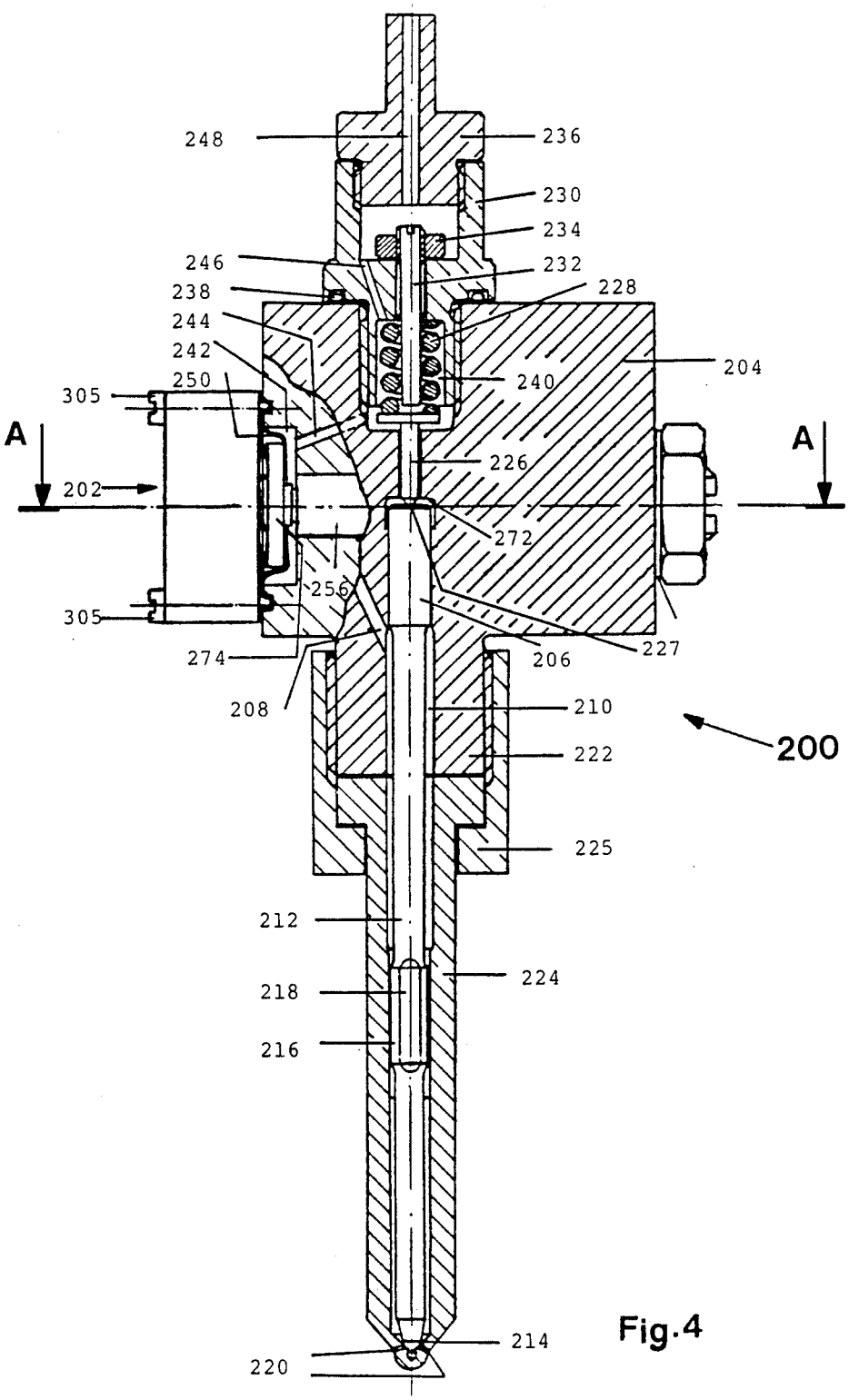
Figure 5:
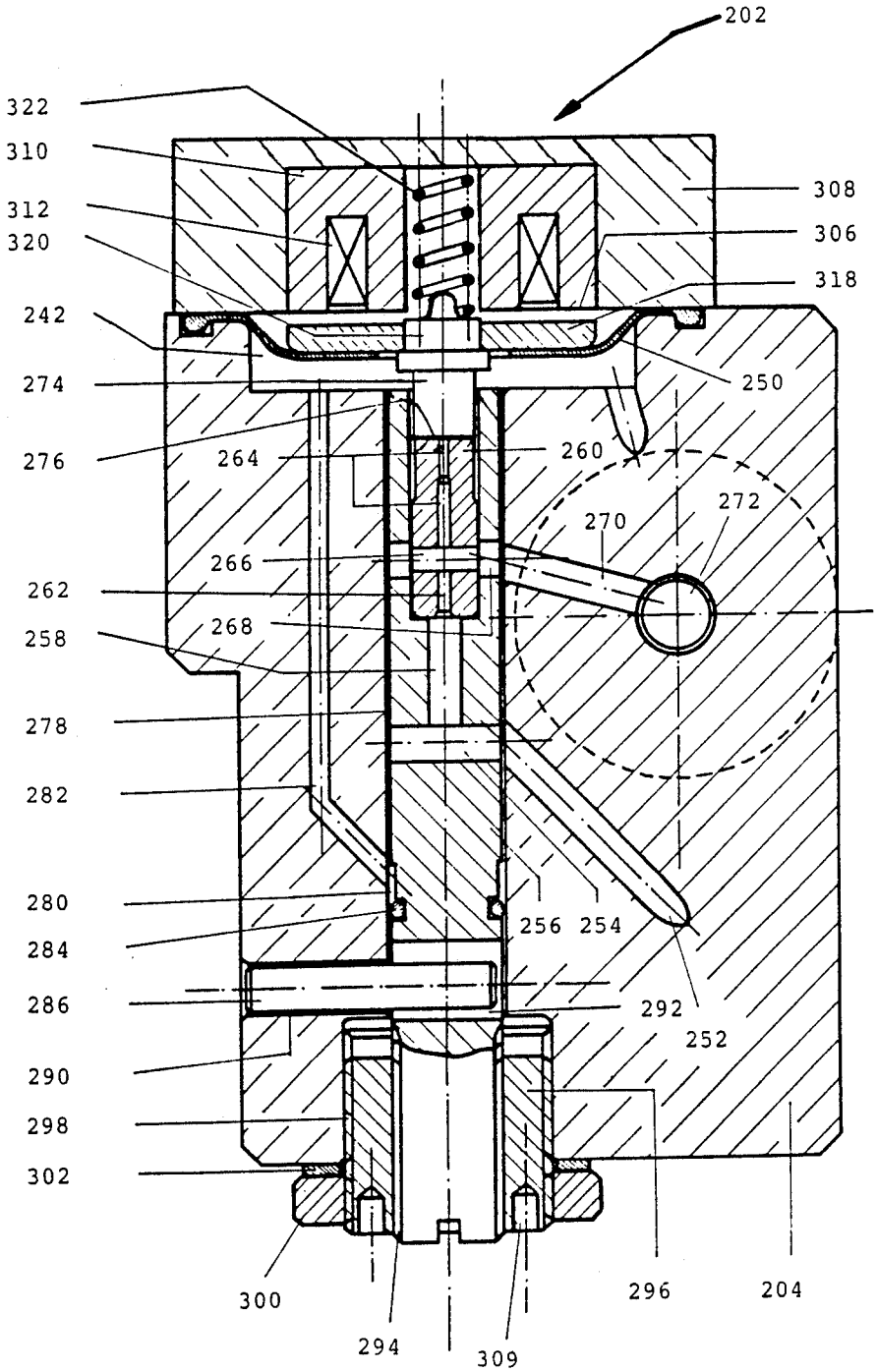

FIGS. *2b*, *2b*,*2c* are enlarged fragmentary axial sectional views of FIG. 1 showing the components which govern the opening and closing operations of the injector needle valve, as well as the formation of the control jet in two restricted orifices during injector operation;

FIG. 3 is a partial axial sectional view of an alternate embodiment of an accumulator injector according to the present invention;

FIG. 4 is an axial sectional view of a second accumulator injector in accordance with the present invention;

FIG. 5 is a cross-section of the injector along line A—A of FIG. 4; and

Figure 6:
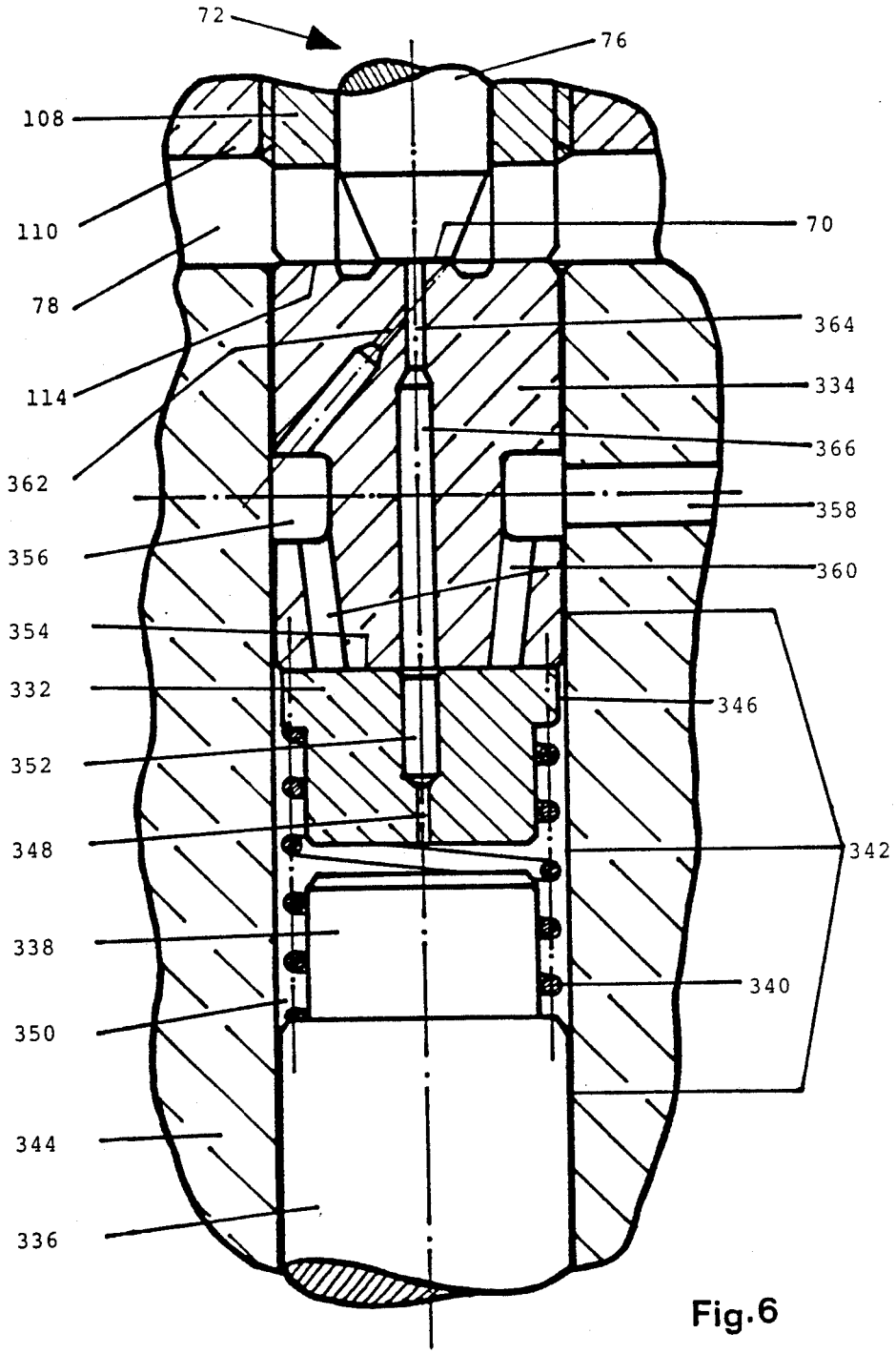

FIG. 6 is an enlarged fragmentary axial sectional view of further alternate embodiment of the present invention.

DETAILED DESCRIPTION OF THE PREFERRED EMBODIMENTS

Turning to FIG. 1, an accumulator injector in accordance with the present invention is designated by the numeral 10, and with reference to the other FIGURES like numerals represent like parts throughout the several FIGURES shown. The accumulator injector 10 is employed in a fuel injection system (not illustrated) for injecting pressurized fuel into the combustion chamber of an internal combustion engine.

The pressurized fuel enters the injector housing 18 through a passage 12 and reaches an annulus 14. A cylindrical piece 20 is guided in the guide-bore 16, which is machined on the longitudinal axis of the injectors housing 18. The cylindrical piece 20 is axially movable and its outer diameter is precisely matched to the guide-bore 16 of the injectors housing 18. This greatly diminishes the leakage of fuel from the annulus 14 into the neighbouring locations of the injector housing 18. The cylindrical piece 20 is provided with two bores 22, which connect the annulus 14 with a second annular passage 24. The cylindrical piece 20 is closed on the upper end with the exception of a restricted passage 26. The axis of the restricted passage 26 is located on the longitudinal axis of the injector 10. Passage 26 shows on one end a conical enlargement 27. The internal bore 28 of the cylindrical piece 20 guides the piston 30 of an injector needle valve 32. The bore 28 is closely matched to the diameter of the piston 30. From the annular passage 24 machined into the piston 30 two passages 34 and 36 start. One end of the restricted bore 38 is connected to the comparatively large passage 34, while the other end of the restricted bore 38 terminates on the flat upper end surface 40 of the piston 30 of the injector needle valve 32. The axis of the restricted bore 38 is located on the longitudinal axis of the injector, like the restricted passage 26. The cylindrical piece 20 and the flat upper end surface 40 of the piston 30 define a small volume or control chamber 42. The distance between the flat upper end surface 40 and the inner, flat surface of the cylindrical piece 20 corresponds to the maximum distance the injector needle valve 32 can travel when the injector needle valve 32 is displaced from its seat 48. This distance corresponds to the needle valve lift "L" (FIG. 1).

The small volume or control chamber 42 is communicating through the restricted bore 38 with the high pressure inlet passage 12. Through the restricted passage 26 it is possible to selectively connect the control chamber 42 with regions of low fuel pressure, as will be described later in more detail. Except through those two restricted bores 26 and 38, the control chamber 42 is essentially not communicating with other regions of the accumulator injector 10. As it will be explained hereinafter, it is of importance that the restricted bores 26 and 38 have a common longitudinal axis, and that the restricted bore 26 shows a conical enlargement 27, like a funnel, on its end facing the control chamber 42.

One end of a further restricted bore 44 is connected to the comparatively large passage 36, the other end of this restricted bore 44 being connected to the injector accumulator chamber 46. In this way the injector accumulator chamber 46 is connected to the high pressure inlet passage 12.

As already mentioned, the cross sections of the three passages 26, 38 and 44 are much smaller than the other passages connecting them to the high pressure inlet passage 12.

The injector accumulator chamber 46 extends from the lower side of the cylindrical piece 20 to the needle valve seat 48 which is machined into the injector tip 50. The injector tip 50 is provided with injection orifices 52. As shown in FIG. 1, the tip of the needle valve 32 closes these orifices 52 when the needle valve tip is engaged with the seat 48, thus preventing the passage of fuel from the injector accumulator chamber 46 through the orifices 52 into the combustion chamber of the related internal combustion enginge (not shown). Such an arrangement of the needle valve tip and the injector tip 50 is usually called zero sac type design, as no intermediate sac exists between needle valve tip and the entrance of the injection orifices 52. A sac type, a throttle type or also a poppet type design of those elements could also be used.

The injector needle valve 32 is axially shiftable in order to produce intermittent injections, each one of them metering a desired quantity of fuel into the combustion chamber of the related internal combustion engine (not shown).

The volume of the injector accumulator chamber 46 exceeds by far the amount of fuel metered during each injection cycle.

The injector tip 50 is connected to the housing 18 by means of a press-fit 54. The needle valve 32 is closely guided by a needle valve guide 56 provided in tip 50. The hydraulic connection between the upper-and the underside of the valve guide 56 is provided by a number of passages 58, one of which is shown in FIG. 1. These passages are machined in the needle valve 32. The total cross sectional area of the passages 58 is big compared to the total cross sectional area of the injection orifices 52

An injector needle valve spring 60 is located in the accumulator chamber 46 and is held compressed between the lower side of the cylindrical piece 20 and a spring support 62. The support 62 is closed on its circumference and conically shaped on the inner side. A conical, slotted ring 64 is placed between the inner conical surface of the spring support 62 and a conical section 66 of the needle valve 32. The slot of ring 64 is large enough to allow the ring 64 to be placed onto the needle valve 32 at the location of its thinner section 68. After inserting the ring 64 onto the needle valve 32, the spring support will be placed onto the ring 64. Both elements 62 and 64 will be pressed against the conical section 66 of the needle valve 32 by the spring 60 once the injector 10 is assembled. Instead of a slotted ring 64 two seperate half-rings could be used. The taper of those elements is preferably chosen such that the parts remain clamped together once they have been assembled.

One end of the restricted passage 26 of the cylindrical piece 20 ends in a flat surface defining a valve seat 70 for a solenoid needle valve or pilot valve 72. The latter can be operated by a solenoid 74. With the solenoid deenergized, the tip of the shaft 76 of the solenoid needle valve or pilot valve 72 is engaged with its corresponding seat 70 on the cylindrical piece 20 and prevents fuel from flowing through the restricted passage 26 into a ring-shaped relieve space or chamber 78.

The relieve-space or chamber 78 communicates via two openings 80 and 82 of big cross sectional area with a discharge chamber 84. Fuel passing the pilot valve seat 70 during injector operation as well as a small amount of fuel leaking from the annulus 14 through guide bore 16 into the relieve space 78 is flowing back to a fuel tank via a bore 84 and return line (tank and return line are not shown in FIG. 1). The fuel pressure in the above mentioned return path from the relieve space or chamber 78 to the fuel tank is very small compared to the fuel pressure in the other already described parts of the injector 10.

The solenoid 74 is placed inside of an adjusting housing 88. A disc 90 is provided with an outer screw thread 92, a big central hole 94 and two incisions 96. The adjusting housing 88 has an internal screw thread matched to the thread 92. The disc 90 can thus be threaded into the adjusting housing 88 in order to clamp the solenoid 74 between the disc 90 and a flat section 98 machined in the adjusting housing 88. The disc 90 can be tightened with a tool engaging the two incisions 96. Electrical connections 100 of the solenoid 74 project through the hole 94 of disc 90.

The outer border of an elastic membrane 104 is clamped between a further flat section 102 (machined in the adjusting housing 88) and the solenoid 74. The inner border of membrane 104 is connected firmly to the armature 106 of the solenoid needle valve or pilot valve 72 in such a way that membrane 104 and armature 106 cannot be separated from one another. The armature 106 is furthermore firmly connected to the needle shaft 76 by means of a press-fit, by welding the two parts together or by another suitable connection.

In this way it is possible to seal the upper side of the armature 106 from the areas containing fuel. This allows the armature 106 to move faster when the solenoid is energized or deenergized, because no counteracting caused by the presence of fuel slow down the solenoid needle valve speed. The opening and closing motion of the solenoid needle valve 72 must be faster than the opening motion of the injector needle valve 32 in order to achieve precise and repeatable control of the opening behaviour of the injector needle valve 32, which is done by a jet, as shall be explained hereinafter in more detail. A screw 108 threaded to the adjusting-housing 88 is provided with a guide-bore for the shaft 76 of the solenoid needle valve or pilot valve 72. The screw 108 can be locked in place by countering it with a bolt 110, so that screw 108 is fixed relatively to the adjusting housing 88. Screw 108 is provided with two radially arranged slots 112, through which the fuel discharged from the restricted passage 26 across the solenoid needle valve seat 70 can flow into the relieve space 78.

Screw 108 enables the setting of the lift of the solenoid needle valve 72 to a desired value. To this purpose the bolt 110 will first be loosened and the solenoid needle valve 72 will be positioned such that the upper part of the armature contacts a stop placed on the solenoid pole face side (not shown in FIG. 1). The solenoid 74 has previously been positioned relatively to the adjusting housing 88 and is locked in place by the disc 90. The screw 108 can be turned with an appropriate tool (similar to a screwdriver) fitted into the two slots 112 to adjust the distance between a flat lower surface 114 of screw 108 and the seat 70 in the tip of shaft 76 until this distance corresponds to the desired solenoid needle valve lift. To this point the screw 108 can be locked in place again by tightening the bolt 110.

The adjusting housing 88, the solenoid 74, the disc 90, the screw 108 and the bolt 110 form now a single unit containing a solenoid needle valve which can perform a desired axial movement. This unit can be assembled and adjusted before mounting it into the injector housing 18. The solenoid needle valve lift adjusting operations can easily be performed by an automatic adjusting machine. Once this unit is mounted together with the remaining parts of the accumulator injector 10 into the injector housing 18, the flat surface 114 of screw 108 will contact the flat upper part of the cylindrical piece 20, which substantially has the same plane as the seat 70 of the cylindrical piece 20 and the solenoid needle valve shaft 76. In this way the desired shifting distance of the solenoid needle valve 72 will be maintained also during injector operation.

As already explained, the seat 70 is designed as a flat seat. For this reason a slight sidewise misalignement of the parts does not affect the sealing function of the seat 70 when the pilot valve 72 is closed. Furthermore, despite a small bore diameter of the restricted passage 26, the seat stress to the contacting materials is reduced compared to a conical seat due to the large contacting area of the coacting parts. Also, the hydraulic force transmitted from the restricted passage 26 to the solenoid needle valve shaft 76 is small compared to the hydraulic forces which operate the injector needle valve 32.

The adjusting housing 88 shows on its upper portion an external screw thread 116. An intermediate piece 118 is provided with an internal thread, an external screw thread and two slots 119. The internal thread of the intermediate piece 118 is matched to the thread 116 of the adjusting housing 88 and the pitch of this internal thread differs from the pitch of the external thread of the intermediate piece 118. The external thread of the intermediate piece 118 is matched to an internal thread 120 machined in the upper part of the injector housing 18. In the injector housing 18 is arranged a positioning pin 122, which protrudes into the slot-shaped opening 80 machined into the adjusting housing 88. The pin 122 prevents the adjusting housing 88 from rotating relatively to the injector housing 18 during assembly of the parts.

A rotation of the intermediate piece 118 (performed with the aid of a tool fitted into the two slots 119) will axially move the unit composed by adjusting housing 88, solenoid 74, disc 90, screw 108 and bolt 110, with preadjusted lift of the solenoid needle valve 72, relatively to the injector housing 18. Together with this unit also the cylindrical piece 20 moves axially in its guide bore 16 relative to the injector housing 18 and the injector needle valve 32. The flat surface 114 of screw 108 and the corresponding flat surface of the cylindrical piece 20 as well as the injector needle valve tip and the injector needle valve seat 48 are kept engaged by the compression force of the injector needle valve spring 60 during injector assembly. The rotation of the intermediate piece 118 thus causes a change to the axially shifting distance "L" of the injector needle valve 32. Therefore the injector needle valve lift "L" can also be adjusted to a desired value. Once this valve lift "L" has been set, all the parts except for the solenoid needle valve 72 and the injector needle valve 32 can be locked in place by countering them with a bolt 124 and a lock-washer 126. This adjusting operation can also easily be performed by means of an automatic adjusting machine.

A first advantage of the injector design shown in FIG. 1 results from the fact that the injector housing 18 can be made of one piece. Because all the described injector elements can be mounted in the interior of the injector housing 18 from its top, it is not necessary to divide the injector housing 18 into two or more parts, as this is the case in previous designs of accumulator injectors. Because separation of parts along planes passing through high pressure bores or passages is avoided, the need for sealing the parts when they are assembled is thus avoided.

The injector tip 50 can be connected to the injector housing 18 by means of a screw thread or a threaded outer connection bolt or, as shown in FIG. 1, by pressing the tip into the housing 18. The solution with a connecting bolt is more convenient if the injector tip 50 is subject to wear and must be replaced from time to time. The method shown on FIG. 1 avoids the need for sealing the two parts as it is the case when using a connecting bolt. On the other hand, the replacement of the injector tip is not easy in the embodiment as shown.

A second advantage of the embodiment disclosed is the result of the fact that all axial tolerances of the injector elements placed on the longitudinal axis of the injector can be large. The variation in the lengths of injector parts due to tolerances do not influence the final result of a desired value for the injector needle valve lift "L" and the solenoid needle valve lift, because those dimensions can be adjusted during the injector assembly and the calibration operations as previously described.

The tight fits of injector 10 are: the injector needle valve tip and its corresponding seat 48, the needle valve guide 56, the fit between the piston 30 of the injector needle valve 32 and the internal bore 28 of the cylindrical piece 20 as well as the fit between the outer cylindrical surface of the cylindrical piece 20 and the guide bore 16. Only this last-mentioned fit is an additional tight fit compared to a conventional fuel injector design. FIG. 1 also shows the design of the solenoid needle valve spring 128 and its tensing mechanism.

The solenoid needle valve spring 128 is a round bendable bar, supported in the middle by a pin 130 placed in a bore in the adjusting housing 88. One end of the spring 128 extends through a bore 132, provided in the shaft 76 of the solenoid needle valve 72. The other end is resting on a rounded nose of a tensing element 134. On this end the solenoid needle valve spring 128 has a round, thicker section which positions spring 128. The tensing element 134 can be axially moved by a tensing screw 136, for setting the tension of spring 128 depending upon the position of the tensing element 134. Once the desired spring tension has been reached, the tensing screw 136 can be locked by countering it with a bolt 138 and a washer 140. This external adjustment can also be performed by an automated machine.

The bendable spring bar 128 has a higher resonant frequency than a spiral spring of similar spring force. Because of the fast motion of the solenoid needle valve 72, a high spring resonant frequency is desired. Springs with a low resonant frequency deflect locally due to fast motions and are often overstressed. In the embodiment shown, the moving part of spring 128 has a little mass, which is another desired property in case of fast moving parts.

A cover 142 is attached to the injector housing 18 by a number of threaded pins 144 and held in place by the bolts 146. The cover 142 serves as a guide for the tensing element 134, defines internally the discharge area 84 and the bore 86 as well as an internal screw thread to which a feed-back connection can be threaded. An additional internal screw thread is machined in the lower part of the cover 142, this thread being matched to the thread of the tension screw 136. The low pressure section of the injector 10 is sealed by two O-ring seals 148 and 150. An electric connection plug 152 is plugged on the upper end of the injector 10. This plug electrically connects the coil of solenoid 74 to an electronic control unit (not shown). The mode of operation of injector 10 is as follows:

At a given time relative to a given engine crank shaft position, the solenoid 74 is energized by an electric pulse of a selected duration. Due to the consequent electromagnetic exitation force the armature 106 is attracted which results in a retraction of the solenoid needle valve 76 away from its seat 70 against the force of spring 128. Thus the restricted passage 26 is opened.

Figure 2A:
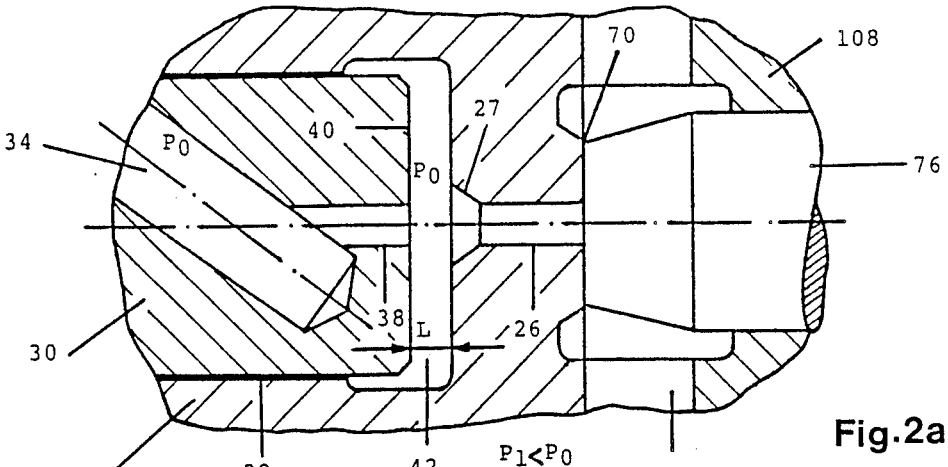
Figure 2B:
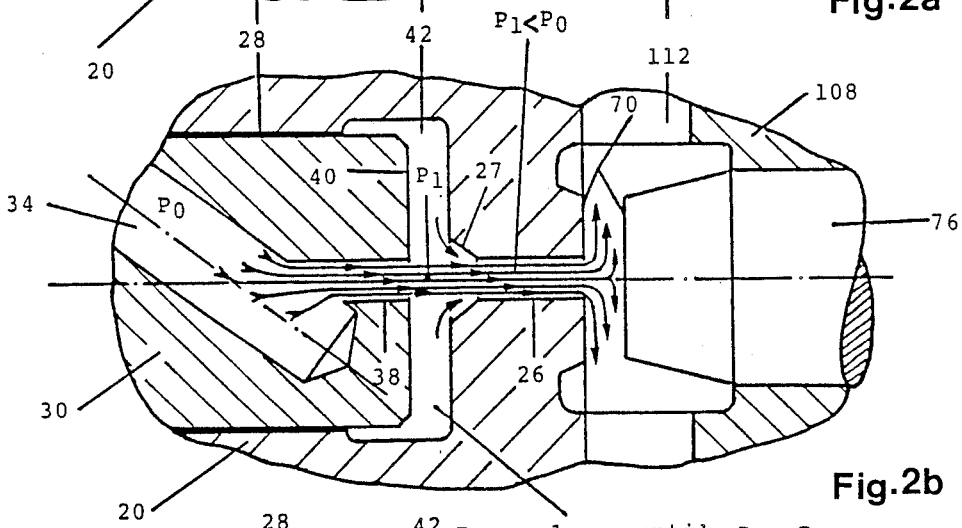
Figure 2C:
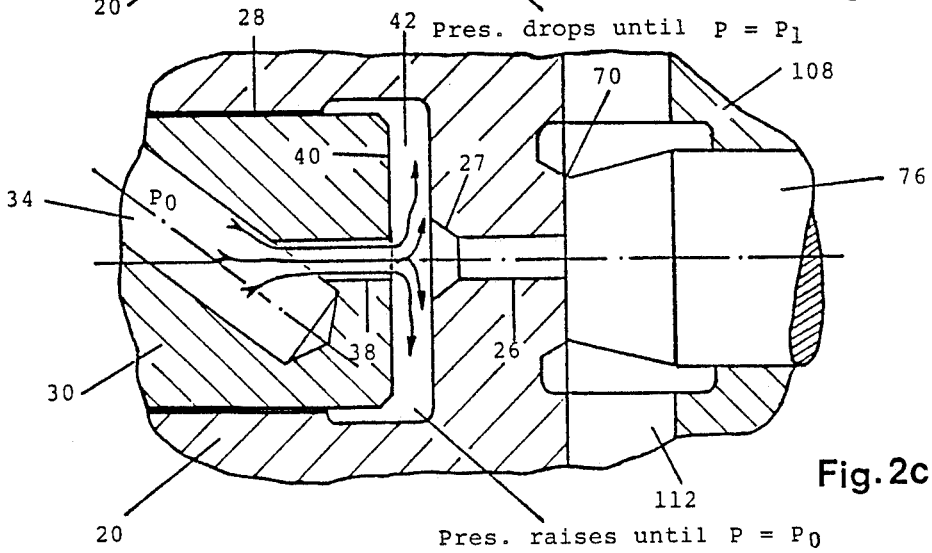

Due to the pressure differential between the control chamber 42 and the relieve space 78 a fuel flow develops in the restricted passage 26, which in turn results in a fuel flow in the restricted bore 38, as illustrated in FIGS. 2*a* to 2*c*. Due to the facts that the longitudinal axis of the restricted passage 26 and 38 coincide at an angle which may be an acute angle (not shown) and the entrance of the restricted passage 26 shows a conical enlargement 27; and because the free length "L" of the forming jet is short ("L" equals to the maximum lift of the injector needle valve 32 or to part of it), a single jet will develop and extend from the junction of restricted bore 38 with the comparatively large passage 34 to the outlet of the restricted passage 26 on the side of the seat 70 of the solenoid needle valve 72.

As shown in FIG. 2*b*, the fuel pressure P1 in the jet is lower than the pressure $P_o$ in the comparatively large passage 34 ($P_o$ is essentially equal to the pressure in the inlet passage 12).

The fuel pressure in the small volume 42 aims to become equal to the pressure P1 in the jet as fast as possible. The physical law governing this phenomena is known from many other applications, for example from the Venturi tube. The pressure in the side bore of a Venturi tube is equal to the static pressure when flow develops in the Venturi tube, and this static pressure is lower than the total initial pressure in the medium used.

In the embodiment according to the present invention, this known effect occuring in a side bore is extended to a surrounding surface, and a simple jet is created during injector operation, whereby the physical properties of the flowing medium are not influenced by this fact.

It is important that the jet does not fan-out in the control chamber 42. The conical enlargement 27 helps to prevent such a fanning-out.

The physical law governing the pressure in the control chamber 42, as just described, differs substantially from the methods described in the Swiss Patent Specification 434 875, and in U.S. Pat. Nos. 3,464,627; 3,610,529 and 3,680,782. In these publications the pressure in the small volume or control chamber on top of the injector needle valve piston is controlled by a restricted inlet and a restricted outlet bore. The restricted outlet bore can be opened and closed by a solenoid operated needle valve. The fuel flowing with high velocity from the restricted inlet bore into the small volume or control chamber on top of the injector needle valve piston fans out into this control chamber which results in turbulencies and therefore cavitation which greatly diminish the pressure-response in this volume. The jet entering the control chamber is not the same as the jet leaving the control chamber through the restricted outlet bore. Because small geometrical dimensions of the chamber on top of the injector needle valve piston as well as considerable pressure drops with consequent high flow velocities are essential for the function of the injector, it is not possible to avoid cavitation with the method described in the above mentioned prior art publications. It is thus not possible to achieve precise and repeatable control upon the opening and closing movements of the injector needle valve. This is however possible with the method and injector according to the present invention.

Returning now to the description of the mode of operation, it has to be noted that at this instant the pressure in the accumulator chamber 46 has not substantially changed and is still equal to the pressure in the passage 12. When a given pressure drop has occured in the control chamber 42, the injector needle valve 32 will be lifted away from its seat 48 due to the force of the pressure in the accumulator chamber 46 acting on the lower side of the piston 30. Consequently the injection event begins by discharging pressurized fuel through the injection orifices 52. During the injection event the pressure in the accumulator 46 drops to a certain degree.

Because of the very fast response of the pressure in the control chamber 42 due to the fuel jet and to the fast supporting action of the solenoid needle valve 72 it will be possible to effectively control the opening and closing movements of the injector needle valve 32 as already mentioned and thus improve combustion and reduce polluant emissions in the combustion chambers of the related internal combustion engine.

If the current to the solenoid 74 is interrupted, the solenoid needle valve 72 will quickly close the restricted passage 26. Consequently the pressure in the small volume or control chamber 42 and acting upon the flat upper end surface 40 of the piston 30 of the injector needle valve 32 will quickly rise. As a consequence the injector needle valve 32 will be shifted in its closing position in which it engages its seat 48 due to the pressure force acting on the flat upper end surface 40 of the piston 30. Thus the injection cycle will be interrupted.

As mentioned above, due to the restricted bore 44, the pressure in the accumulator chamber 46 drops somewhat during the injection cycle. The restricted bore 44 does not allow to immediately fully supply the fuel discharged through the injection orifices 52 during the injection cycle. However, the pressure in the accumulator chamber 46 will be fully restored after termination of the injection cycle, due to supply of fuel through restricted bore 44. The fuel supply from passage 12 through restricted bore 44 will end when the pressure in the accumulator chamber 46 has become equal to the pressure in the passage 12. Because of the restricted bore 44 the filling of the accumulator chamber 46 occurs slowly compared to the injection event. In this way it is possible to suppress pressure pulsations in the injection system. The use of a restricted bore 44 as a connection between a fuel entering passage in the injector and the accumulator chamber 46 has already been described in the U.S. Pat. No. 4,566,416 and the corresponding German Published Application 32 27 742. The manufacture of this restricted passage 44 into the piston 30 of the injector needle valve 32 is simple an poses no great difficulties. It has to be noted that the injector needle valve 32 never moves through its entire lift "L" during the injection cycles. This means that the movement of the injector needle valve 32 is never prematurely stopped by a mechanical stop, i.e. The flat surface of the cylindrical piece 20 defining the upper wall of the control chamber 42 (FIG. 1).

FIG. 3 shows an alternate construction layout wherein the fuel supply from the annulus 14 to the accumulator chamber 46 occurs by means of a spring loaded check-valve 154, instead by means of a restricted bore 44 machined into the piston 30 of the injector needle valve 32 as it is the case in the embodiment shown in FIG. 1.

At a given pressure differential between annulus 14 and accumulator chamber 46 fuel flows through bore 156 across the ballcheck 158 into the chamber 160 and from here through bore 162 into the accumulator 46. The spring loaded check valve 154 consists of a ball-check 158, two guide pieces 164 and a spring 166. A screw 168 provided with an axial bore in which a pin 170 is tightly fitted, seals the chamber 160. The pin 170 can be axially shifted by rotating a screw 172, whereby the tensing force of spring 166 and thus the pressure differential needed to open the ball-check 154 is set as required. The screw 172 can be countered and locked in place with a bolt 174. A leakage connection passage 176 connects the relieve space 78 with the back side of pin 170. A threaded cap 178, which is closed on one end, and which is screwed on to the protruding end section of screw 168, and a seal-ring 180 prevent leakage of fuel to the outside of the injector.

Due to the spring-loaded check-valve 154, the pressure in the accumulator chamber 46 is always lower than the pressure in the annulus 14 and consequently also lower than the maximum pressure in the small volume or control chamber 42. For this reason, it is possible to close the injector needle valve 32 at any point of time, particularly then, when just a small fuel quantity has been injected, or even if a pulsation in the line pressure is present. In a more simple version of this construction, a check-valve without a mechanism to adjust the tension of spring 166 can be used.

FIGS. 4 and 5 show an axial sectional view of a further alternate embodiment of an injector 200 according to the present invention. In this design the injector solenoid 202, of which only the outlines are shown, is arranged at an angle of 90° with respect to the longitudinal axis of the injector. As it is apparent from the FIGS. the solenoid 202 can be placed at any angle and at any radial position related to other elements to the injector 200, as may be best suited for a particular application. This injector design has all the positive features of the injector design shown in FIG. 1, such as the possibility of calibrating the injector 200 by means of an automated calibration machine and a simple design.

FIG. 4 shows in detail the means used to set the lift of the injector needle valve when using the present angled arrangement of the solenoid 202 and related elements.

The pressurized fuel entering the body 204 of the injector 200 reaches the lower side of the injector needle valve piston 206 via a bore 208. Upstream of the bore 208 an injector accumulator can be present, which can for example be machined in the body 204 (This is not shown on FIGS. 4 and 5). The accumulator could then be connected to the rail of the injection system in any suitable manner.

A narrow annular space 210 surrounds the injector needle valve 212. This narrow annular space 210 extends from the needle valve piston 206 to the injector tip seat 214. Needle valve 212 shows a second guide 216, which is in addition to the needle valve piston 206. The guide 216 is provided with channels 218. The annular space 210 as well as the channels 218 and also the bore 208 have a cross sectional area which is substantially greater than the total area of injection orifices 220.

The body 204 has a nose 222, to which the injector tip 224 is attached by means of a threaded nut 225. The tip 224 is provided with the needle valve seat 214 and the injection orifices 220 in a zero-sac configuration. An embodiment with a sac-type, a throttle-type or also with a pappet type needle valve tip could also be employed.

As shown in FIG. 4, the injector needle valve 212 is engaged with its seat 214 and prevents fuel to be injected into the combustion chamber of the related internal combustion engine (not shown). The injector needle valve 212 can be axially shifted in order to allow for intermittent injections.

At the upper end of injector 200 the following elements are shown: a pin 226 guided within body 204, spring 228, a spring housing 230, an injector needle valve stop 232 with a countering nut 234 and the fuel return connector 236.

Spring 228 is relatively weak. If the fuel pressure in the injector 200 is low, the tip of the pin 226 and the upper end of the needle valve piston 206 contact at a location designated by the numeral 227. In this case spring 228 holds the injector needle valve 212 in its closed position with the fuel pressure being above a predetermined level, the pin 226 is pushed by the pressure in a small chamber 272 against the injector needle valve stop 232 and away from its contacting position with the needle valve 212. In this case the injector needle valve 212 will be operated only by pressure differential forces acting upon the needle valve piston 206.

The amount of axial shift of the injector needle valve 212 (and at low fuel pressure acting upon pin 226) can be set by screwing the threaded needle valve stop 232 in the appropriate direction relatively to the spring housing 230 and countering the stop with nut 234. The spring housing 230 is provided with a ring seal 238 sealing a spring room 240. This arrangement of the injector needle valve spring 228 allows a very compact design of the tip portion of injector 200.

Furthermore, FIG. 4 shows the fuel spill path from a relieve space 242 to the fuel return connector 236 which is formed by a first bore 244 machined into the body 204 and a second bore 246 machined into the spring housing 230. Finally, return fuel flows through a bore 248 machined into the return connector 236 back to the tank via a low pressure pipe (not shown). Further elements such as an elastic membrane 250 visible on FIG. 4 are explained more in detail hereinafter in connection with FIG. 5.

FIG. 5 is a sectional view of injector 200 along the line A—A in FIG. 4.

A bore 252, provided in the body 204 and arranged at an angle with respect to the cross-sectional plane of FIG. 5, connects the high pressure inlet of the injector 200 (not shown on FIG. 5) with a bore 254 machined into an insert piece 256. Bore 254 communicates with a further bore 258, machined on the axis of the insert piece 256.

The insert piece 256 houses a jet element 260, which is press fitted into the insert piece 256. The jet element 260 shows two axially aligned straight restricted bores 262 and 264. The diameter of the restricted bore 262 and of a first part of the restricted bore 264 is slightly bigger than the diameter of a second part of the restricted bore 264. Perpendicularly to the restricted bores 262 and 264, a bore 266 is machined in the jet element 260 and is traversing the restricted bores 262 and 264. A further bore 268 machined into the insert piece 256 connects bore 266 with a bore 270 provided in the body 204. Finally, bore 270 is connected with the small volume or control chamber 272 located at the upper end of the injector needle valve piston 206. Chamber 272 is also visible in FIG. 4. The cross-sectional areas of the bores 252, 254, 258, 266, 268 and 270 are substantially bigger than the cross sectional areas of the two restricted bores 262 and 264. One end of the restricted bore 264 can be selectively closed by the tip of the solenoid needle valve or pilot valve 274, which shows a flat seat 276 coaching with a flat end surface of the jet element 260.

The outer diameter of the insert piece 256 is closely matched to the bore 278 machined into the body 204, in order to reduce fuel leakage from the high pressure regions of the injector 200 into the neighbouring low pressure regions.

The insert piece 256 has a leakage groove 280. A leakage bore 282 machined into the body 204 connects this groove 280 with the relieve space 242. A seal ring 284 seals tightly this lower end region of the insert piece 256.

A pin 286 guided in a bore 290 machined into the body 204 protrudes into a slot 292 of the insert piece 256. On its lower end, the insert piece 256 is provided with a screw thread 294. An intermediate piece 296 has an internal and an external screw thread, the pitch of the two threads of the intermediate piece 296 being not the same. The internal thread of intermediate piece 296 is matched to the external thread 294 of the insert piece 256, while the external thread of the intermediate piece 296 is matched to an internal thread 298 machined into the body 204. A nut 300 and a lock-washer 302 are also shown.

This arrangement allows to set a desired lift of the solenoid needle valve or pilot valve 274, since the solenoid 202 is firmly attached to the body 204, for example by four screws 305 located on the circumferential region of the solenoid 202. Two of those four screws 305 are shown in FIG. 4. The position of the solenoid pole face 306 is thus fixed relatively to the body 204. A rotation of the intermediate piece 206 by means of a tool fitted in two bores 309 of the intermediate piece 206 will result in an axial shift of the insert piece 256, whereby rotation of the latter is being suppressed by the pin 286, thus also maintaining the high pressure bores in the correct alignment. This axial shifting of insert piece 256 results in a change of the total shifting distance of the solenoid needle valve 274. Once the correct needle valve lift has been set, the insert piece 256 can be locked in place by nut 300 and lockwasher 302. This adjustment can be performed from the outside and with the injector 200 fully assembled.

The solenoid 202 consists of an outer solenoid shell 308, which could be made of plastic material, a soft iron core 310 and a coil 312. The armature 318 of the solenoid 202 is connected to an enlarged portion 320 of the needle valve 274.

An elastic membrane 250 is connected to the armature 318 in a similar way as described in connection with FIG. 1. Its outer border is clamped between the body 204 and the solenoid shell 308. The function of the membrane 250 is the same as described earlier in connection with FIG. 1.

A spring 322 forces the solenoid needle valve 274 against its seat 276 when the solenoid 202 is de-energized. Spring 322 can be replaced by a bendable bar as shown in FIG. 1.

The function of the injector 200 is the same as the function of the injector 10 of FIG. 1 previously described.

The control jet will now develop in the jet element 260 upon retraction of the solenoid needle valve 274 from its seat 276. Since the cross sectional area of the second portion the restricted bore 264 is slightly smaller than the cross sectional area of the restricted bore 262, the flow velocity and thus the pressure drop inside the jet at the location of the crossing bore 266 and inside the restricted bore 262 (and inside the first portion of the restricted bore 264) will be somewhat smaller than in the second portion of the restricted bore 264, according to the physical law governing this phenomena. Still, due to its high velocity, the jet will be able to cross the distance of the crossing bore 266 without fanning out. Since the restricted bore 262 and the first portion of the restricted bore 264 on both sides of the crossing bore 266 are machined in one step and provided in the same piece, they will be perfectly aligned and thus no funnel as used in the embodiment of FIG. 1 is needed to guide the jet. The bigger area of the restricted bore 262 helps to enhance the closing speed of the injector needle valve 212, since a bigger flow can be provided to pressurize the control chamber 272 during termination of the injection cycle.

FIG. 6 discloses an alternate design of the portion of an injector which controls the pressure in the small control chamber on top of the injector needle valve piston, which alternate design can be used in the injector 10 shown in FIG. 1 as well as in the injector 200 shown in FIGS. 4 and 5. FIG. 6 shows only the design suitable for injector 10 (see also FIG. 1). With little modification, the two parts 332 and 334 of the design according to FIG. 6 which determine the behaviour of the pressure in the small control chamber on top of the injector needle valve piston, as shall be explained hereinafter, can be built into the insert piece 256 of injector 200 according to FIGS. 4 and 5. The method to control the injector needle valve opening and closing behaviour with the construction according to FIG. 6 differs somewhat from the method previously described.

The needle valve piston 336 of the injector needle valve shows an upper section 338 having a smaller diameter. On this smaller section 338 a spring 340 is placed. The opposite side of spring 340 is engaging a section of an intermediate valve body 332 having a reduced diameter. Between the upper part of the intermediate valve body 332 and the upper elongated section of a guide bore 342 for the needle valve piston 336, which is machined into the injector housing 344, an annular ring-shaped space 346 of a relatively big cross sectional area is provided. The intermediate valve body 332 is provided with a small bore 348, one end of which is connected with a small chamber 350 on top of the injector needle valve piston 336. The other end of the small bore 348 is connected to a bore 352 having a greater diameter machined in the intermediate valve body 332.

The intermediate valve body 332 has a flat seating surface 354 which acts together with flat seating surface of a pressure control element 334. The control element 334 is provided with a ringbore 356 which is connected to the high pressure inlet connection (not shown) of the injector by a bore 358 of big cross sectional area. A number of bores 360 machined into the control element 334 connects the ring bore 356 with the flat seating surface of control element 334.

A small bore 362 connects the ring bore 356 with a small bore 364 machined on the longitudinal axis of the pressure control element 334. One end of the small bore 364 is connected to the seating surface 70 and can be selectively opened and closed by the solenoid needle valve 72. The other end of the small bore 364 is connected to a bore 366 of greater diameter, which in turn is connected to the bore 352 machined into the intermediate valve body 332. The control element 334 and the injector needle valve piston 336 are tightly fitted into guide bore 342 in order to minimize leakage of fuel from high to lower fuel pressure regions.

The mode of operation of this embodiment to allow for the pressure in the small control chamber 350 to control the injector needle valve opening and closing motions is the following: prior to the beginning of the injection cycle, the intermediate valve body 332 is contacting the control element 334, thus the seating surface 354 prevents the passage of fuel through the bores 360. When the solenoid needle valve 72 is retracted from its seat 70, the fuel pressure in the small bore 364 and consequently also in the bigger bores 366 and 352, in the small bore 348 and finally in the small control chamber 350 quickly drops, which causes the injection needle valve to open and to initiate the injection event.

Because of the small bore 348, the opening motion of the injector needle valve is controlled. To terminate the injection cycle the solenoid needle valve will first close the outlet of the small bore 364. Fuel will now flow from the small bore 362 through a part of the small bore 364 and increase the pressure in the bigger bores 366 and 352. This, together with the fuel pressure prevailing in the bores 360 will momentarily move the intermediate valve body 332 off its engaged position with the control element 334. This results in a big flow area provided through the bores 360 and the ring-shaped space 346 to supply fuel in order to sharply close the injector needle valve.

An advantage of this solution is therefore the provision of a very quick closing motion of the injector needle valve, while maintaining the control upon the opening motion. As an advantage compared to the embodiment of FIG. 1, only a precise fit in an internal bore (guide bore 342) needs to be provided for. In addition, the force transmitted to the upper part of the injector 10 by the fuel pressure will be smaller with this design compared to the design with the cylindrical piece 20, because of the smaller diameter of the control element 334. Still, the injector needle valve lift "L" can be set by moving the pressure control element 334 and consequently the intermediate valve body 332 along the injector axis in the way described earlier.

While preferred embodiments of the present invention have been described for purposes of illustration, the foregoing description should not be deemed a limitation of the invention herein. Accordingly, various modifications, adaptations and alternatives may occur to one skilled in the art without departing from the spirit and scope of the present invention.

I claim:

1. Fuel injection device for intermittently injecting fuel into the combustion chamber of an internal combustion engine, comprising a housing (18;204) with a valve seat (48;214) and at least one discharge orifice (52;220), an elongated injector valve member (32;212) being momentarily shiftable in its axial direction to be lifted form the valve seat (48;214) for opening the discharge orifice (52;220), a control chamber (42;272) provided in said housing (18;201) and being connectable to a fuel supply line (12;208), the fuel pressure in said control chamber 942;272) acting upon said injector valve member (32;212) forcing the latter against said valve seat (48;214), means (26,38;262,264) to quickly reduce and restore the fuel pressure in said control chamber (42;272) to allow for a momentary axial movement of said injector valve member (32;212), said means to quickly reduce and restore the fuel pressure in said control chamber (42;272) comprising two orifices (26,38;262,264) communicating with one another and being connected to said control chamber (42;272) and electrically controlled valve means (72;202) for closing and temporarily opening one end of one (26;264) of said orifices (26,38;262,264), said two orifices (26,38;262,264) being arranged opposite to one another forming an unobstructed passage therebetween such that a single jet controlling the fuel pressure in said control chamber (42;272) is created within said two orifices (26,38;262,264) and in the space therebetween when said valve means (72;202) are lifted off said one end of said one orifice (26;264).

2. Fuel injection device according to claim 1, wherein said two orifices (26,38;262,264) are axially aligned.

3. Fuel injection device according to claim 1, comprising fuel discharge means (48,52;214,220) of a sac-type, a zero sac-type, a pintle type or a poppet type construction.

4. Fuel injection device according to claim 1, wherein said electrically controlled valve means comprise a solenoid operated valve (72;202) comprising a solenoid (74;310,312) with a movable armature (106;318) and a pilot valve member (76;274) connected to said armature (106;318); said solenoid (74;310,312) and said armature (106,318) being sealed against entry of fuel present in said housing (18;204).

5. Fuel injection device according to claim 4, comprising an elastic sealing membrane (104;250) clamped between two stationary parts (74,88;204,308) in a seal-tight manner, said pilot valve member (76;274) being seal-tightedly connected to said membrane (104;250).

6. Fuel injection device according to claim 1, comprising a fuel pressure chamber (46;210) located upstream of said discharge orifice (52;220) and being connectable to the latter, said fuel pressure chamber (46;210) having a volume substantially exceeding the fuel volume to be discharged through said discharge orifice (52;220) during each injection cycle, and further comprising means (154) for selectively connecting said fuel pressure chamber (46;210) with a high pressure fuel inlet (12;252), said connecting means (154) serving to keep the pressure within said fuel pressure chamber (46;210) lower than the pressure in said high pressure fuel inlet (12;252).

7. Fuel injection device according to claim 6, wherein said connecting means (154) comprise a spring loaded differential pressure valve (154), preferably a ball valve, arranged between said fuel pressure chamber (46) and said high pressure fuel inlet (12), said pressure valve (154) being operated by a given difference in pressure in said fuel pressure chamber (46) and said high pressure fuel inlet (12), the force of the spring (166) of said pressure valve (154) preferably being adjustable.

8. Fuel injection device according to claim 1; wherein said electrically operated valve means (72;202) comprise a needle valve or pilot valve body (76;274) having a substantially flat sealing surface acting together with a flat valve seat (70,276) surrounding said one end of said one orifice (26;264).

9. Fuel injection device according to claim 1, wherein the longitudinal axis of said two orifices (26,38;262,264) form an angle.

10. Fuel injection device according to claim 1, wherein said housing comprises a single-piece housing body (18) open at the end opposite said valve seat.(48) for mounting said injector valve member (32), said means (26,38) to quickly reduce and restore the fuel pressure in said control chamber (42) and said electrically controlled valve means (72) in axial alignment within said housing body (18).

11. Fuel injection device according to claim 1, wherein said electrically operated valve means comprise a solenoid operated valve (72) comprising a solenoid (74) and a pilot valve member (76), said solenoid operated valve (72) being axially aligned with said injector valve member (32), the distance of movement (L) of said injector valve member (32) being adjustable by adjustment means (108).

12. Fuel injection device according to claim 11, wherein said adjustment means comprise an adjustment element (108) screw-threaded into a housing member (88) housing the solenoid operated valve (72), the pilot valve member (32) of which extends through a central bore provided in said adjustment element (108).

13. Fuel injection device according to claim 1, wherein said electrically controlled valve means comprise a solenoid operated valve (72) comprising a solenoid (74), an armature (106) and a pilot valve member (76) connected to the armature position closing said one end of said one orifice (26) by a spring member (128) engaging said pilot valve member (76), in an intermediate position between said armature (106) underside and the orifice closing end of said pilot valve member (76).

14. Fuel injection device according to claim 13, wherein said spring member is a bendable spring bar (128).

15. Fuel injection device according to claim 14, comprising means (130,134,136,138) to adjust the force said spring bar (128) is excerting upon said pilot valve member (76), said adjusting means comprising a first support (134) for supporting said spring bar (128) at a first supporting location, said first support (134) being movable in the direction of movement of said pilot valve member (76), said adjusting means further comprising a second support (130) for said spring bar (128) arranged between said first supporting location and the end of said spring bar (128) engaging said pilot valve member (76), said two supports (134,130) supporting said spring bar (128) at opposite sides of the latter.

16. Fuel injection device according to claim 1, comprising a fuel pressure chamber (46) located upstream of said discharge orifice (52) being connectable to the latter, said fuel pressure chamber (46) having a volume substantially exceeding the fuel volume to be discharged through said discharge orifice (52) during each injection cycle, said fuel pressure chamber (46) being connected to a high pressure fuel inlet (12) by means of a restricted passage (44) provided in said injector valve member (32).

17. Fuel injection device according to claim 1, wherein said injector valve member (32) is provided with a piston part (30) at a first end opposite a second end acting together with said valve seat (48), said injector valve member (32) being further provided with supporting means (62,64) for supporting one end of a valve spring member (60), the other end of which resting upon a stationary support (20), said supporting means (62,64) being located between said piston part (30) and said second end.

18. Fuel injection device according to claim 17, wherein said supporting means comprise a ring-shaped supporting element (62) supporting said one end of said valve spring member (60), said supporting element (62) being provided with a conically shaped inner bore and resting on an intermediate member (64) provided with an outer conical surface, said intermediate member (64) having a conically shaped inner passage and sitting on a conically shaped section of said injector valve member (32), said intermediate member (64) being preferably slotted or composed of two halves.

19. Fuel injection device according to claim 1, comprising a valve spring (228) acting upon said injector valve member (212) for urging the latter against said valve seat (214) and further comprising control means (226) for causing said valve spring (228) to urge said injector valve member (212) against said valve seat (214) only when the fuel pressure in said control chamber (272) is lower than the highest operating pressure.

20. Fuel injection device according to claim 19, wherein said control means comprise a pin (226) movable in direction of movement of said injector valve member (212), one end of said pin (226) being supported by said valve spring (228) and the other end of said pin (226) extending into said control chamber (272) and engaging said injector valve member (212).

21. Fuel injection device according to claim 20, further comprising a stop member (232) for determining the amount of movement of said pin (226) and said injector valve member (212) provided in a stationary member (230) and axially aligned with said pin (226) and said injector valve member (212), the position of said stop member (232), being adjustable in the direction of the common axis.

22. Fuel injection device according to claim 1, wherein said electrical valve means comprise a solenoid operated valve (202) comprising a solenoid (310,312) and a pilot valve member (274) guided for axial movement in said housing (204), further comprising setting means (256,296) for setting the length of movement of said pilot valve member (274) after the completion of assembly.

23. Fuel injection device according to claim 1, comprising a ring-shaped channel (14) arranged coaxially to said injector valve member (32) and connected to a high pressure fuel inlet (12), said channel (14) being further connected with said orifices (26,38) and communicating with a fuel pressure chamber (46) arranged upstream of said discharge orifice (52) and being connectable to the latter.

24. Fuel injection device according to claim 1, wherein the other one (38) of said two orifices (26,38) provided in said injector valve member (32) and preferably extends in the longitudinal axis of the latter, one end of said orifice (38) being connected to a high pressure fuel passage (34) and the other end discharging into an end surface (40) of said injector valve member (32).

25. Fuel injection device according to claim 1, wherein said one (26) of said two orifices (26,38) is provided in a cylindrical member (20) held in said housing (18), said cylindrical member (20) being provided with an internal bore (28) receiving and guiding one end section (30) of said injector valve member (32), the end of said one orifice (26) not closed by said valve means (72) being in communication with one end of the other orifice (38).

26. Fuel injection device according to claim 25, wherein said control chamber (42) is defined by said end surface (40) of said injector value member (32) and the bottom wall of said internal bore (28) within said cylindrical member (20).

27. Fuel injection device according to claim 1, wherein said one (26) of said two bores (26,38) is provided with an enlarged, preferably conical or rounded orifice entrance (27) at the end not closed by said electrically controlled valve means (72).

28. Fuel injection device according to claim 1, wherein said two orifices (262,264) are both provided in a stationary member (260), said stationary member (260) being further provided with a bore (266) extending transversally to said orifices (262,264) and crossing the latter, said bore (266) being connected to said control chamber (272).

29. Fuel injection device according to claim 1, wherein said other (262) of said two orifices (262,264) is connected to a high pressure fuel passage (258) and has a greater cross-sectional area than said one (264) of said two orifices (262,264).

30. Fuel injection device according to claim 1, wherein said stationary member (260) is received in an elongated connecting member (256) located in a bore (254) provided in said housing (204), said connecting member (256) being provided with means (254,258,268) for connecting one (262) of said orifices (262,264) with a high pressure fuel inlet (252) and said transverse bore (266) with said control chamber (272), said connecting member (256) being movable in the direction of its longitudinal axis in order to set the movement of said pilot valve member (274).

31. Fuel injection device according to claim 30, comprising means (286) for preventing rotation of said connecting member (256) during its axial movement.

32. Fuel injection device according to claim 11, wherein said solenoid (74) and said pilot valve member (76) are located in a housing member (88) movably arranged in said housing (18), said housing member (88) being movable by means of a cylindrical adjustment element (118) provided at its outer side with a first screw thread (120) engaging a screw thread in said housing (18) and at its inner side with a second screw thread (116) engaging a screw thread at the outside of said housing member (88), the pitch of said two screw threads (116,120) being different from one another.

33. Fuel injection device according to claim 30, comprising a cylindrical adjustment element (296) for axially moving said connecting member (256), said adjustment element (296) being provided at its outer side with a first screw thread (298) engaging a screw thread provided in said housing (204) and at its inner side with a second screw thread (294) engaging a screw thread at the outer side of connecting member (256), the pitch of said two screw threads being different from one another.

34. Fuel injection device according to claim 1, comprising means (39, 26, 42; 262, 264, 266, 268, 270, 272) for hydraulically controlling the opening and quickly closing movement of said injector valve member (32;212) and for stopping the opening movement of said injector valve (32;212) by hydraulic forces only.

35. Fuel injection device according to claim 34, wherein the fuel discharge means (48, 52; 214, 220) are of zero-sac type construction.

* * * * *